United States Patent [19]

McGuire et al.

[11] Patent Number: 4,589,590

[45] Date of Patent: May 20, 1986

[54] INTEGRAL MULTIPLE USE MESSAGE UNIT PACKAGE AND METHOD OF MAKING IT

[76] Inventors: Thomas L. McGuire, 116 W. Carmel Valley; Robert M. Steinberg, 96 Quien Sabe, both of Carmel Valley, Calif. 93924

[21] Appl. No.: 680,662

[22] Filed: Dec. 12, 1984

Related U.S. Application Data

[63] Continuation-in-part of Ser. No. 471,481, Mar. 2, 1983, abandoned.

[51] Int. Cl.[4] ..... B42D 15/02

[52] U.S. Cl. ..... 229/92.8; 156/291; 428/198

[58] Field of Search ..... 229/92.8, 73, 69; 283/63 R; 281/21 R; 428/198; 156/291

[56] References Cited

U.S. PATENT DOCUMENTS

| | | | |
|---|---|---|---|
| D. 125,147 | 2/1941 | Bernhardt | 229/92.8 |
| 263,347 | 8/1882 | Mead | 229/92.8 |
| 632,788 | 9/1899 | Philipp | 283/63 R |
| 669,959 | 3/1901 | Leigh | 283/63 R |
| 695,617 | 3/1902 | Lyne | 229/92.8 |
| 725,963 | 4/1903 | Hoffmann | 229/92.8 |
| 879,802 | 2/1908 | Taylor | 229/92.8 |
| 1,942,287 | 1/1934 | Heitz | 229/92.8 |
| 2,045,944 | 6/1936 | Domke | 229/92.8 |
| 2,243,974 | 6/1941 | Mitchell | 229/92.8 |
| 2,277,265 | 3/1942 | Zahniser | 281/21 R |
| 2,805,816 | 9/1957 | Morgan | 229/92.8 |
| 3,587,844 | 6/1971 | Wing | 229/69 |
| 4,339,299 | 7/1982 | Snellman et al. | 156/563 |

FOREIGN PATENT DOCUMENTS

| | | | |
|---|---|---|---|
| 191725 | 9/1957 | Fed. Rep. of Germany | 229/92.8 |
| 464604 | 3/1914 | France | 229/92.8 |
| 18738 | 2/1899 | Switzerland | 229/92.8 |

*Primary Examiner*—Stephen P. Garbe

*Attorney, Agent, or Firm*—Leonard Bloom

[57] ABSTRACT

An integral multiple use message unit package having a display surface and a plurality of individual message units removably adhered to the backside of the display surface. In one embodiment, the individual message units may be adapted to be filled out with a message and an address, stamped and mailed. Upon receipt, the top message unit with the message can be removed by the recipient, revealing a fresh message unit and allowing the process to be repeated. In another embodiment of the invention, the message unit package is for direct mail advertising and the individual message units may be post cards having advertising material printed on one side and postage and the advertiser's address printed on the other side. Thus, the recipient of the advertisement may conveniently indicate on the appropriate message unit, or post card, his level of interest in the goods or services offered and mail it back to the sender. Alternatively, the message unit may be an indicia-bearing envelope having an advertising message and the advertiser's return address and postage printed thereon. The indicia-bearing envelope permits the recipient to safely enclose, for example, a prior to mailing it back to the advertiser. Combinations of the above individual message units can be varied as desired.

28 Claims, 21 Drawing Figures

INTEGRAL MULTIPLE USE MESSAGE UNIT PACKAGE AND METHOD OF MAKING IT

This is a continuation in part of application Ser. No. 471,481, filed Mar. 2, 1983 now abandoned, the disclosure of which is incorporated herein in its entirety.

BACKGROUND OF THE INVENTION

The present invention relates generally to post cards and direct mail advertising, and more specifically to an integral multiple use message unit package.

A post card has always been, and continues to be, the most cost effective means of communication used in the Postal Service. With the escalation of postal charges over the past decade, cost becomes a factor in the communication link between individuals, family members, and friends and between businesses and prospective customers. The cost of the postage is not the only factor. The cost of purchasing a post card has escalated greatly, and if one is required to purchase a new post card for each communication, then the overall cost may be considerable. Furthermore, the psychological impediment of having to run a special errand to locate an appropriate post card for each communication tends to put it in the category of things that never get done. In the area of direct mail advertising, businesses often mail to prospective customers envelopes filled with promotional coupons and/or cards to be returned to the business by the recipient to order or to indicate his level of interest in the goods or services offered, or to request additional information. This material is often bulky, and thus the costs of printing, stuffing the envelopes, and mailing are significant. Moreover, the recipient is often likely to discard the entire package of material rather than look through a large number of loose coupons or promotional material to determine if he has any interest in the goods or services offered.

Additionally, little or no information can be conveyed and made available to the customer until the envelope is opened. Advertisers often seek to reach potential customers by placing removable post cards or removable indicia-bearing envelopes in magazines directed to a certain class of subscribers. Not only is this type of advertising competitive, expensive, and provide an envelope with sketchy information, but it is also not cost effective; the removable cards or envelopes may fall out of the package, or are often ignored by the reader who is likely to be engrossed in what he is reading. In addition, burying the cards or envelopes among the large number of pages in the magazine means that the reader may never even come across them, particularly if he does not read every page of the magazine, and may not appreciate the advertised product or its manufacturer.

The foregoing problems are addressed and solved in the present invention which provides an integral multiple use message unit package having a display surface with a plurality of individual message units removably adhered to the backside thereof, preferably by means of edge gluing along the outer edges thereof. In one embodiment of the invention, the individual message units may be adapted to be filled out with a message and an address, stamped, and mailed. Upon receipt, the top message unit with message can be removed by the recipient, revealing a fresh message unit or plural message units sandwiched therein and allowing the process to be repeated. In another embodiment of the invention, the message unit package (comprising preferably from 2 to 33 individual cards or sheets, printed on both sides) is intended for direct mail advertising; and the individual message units may be post cards having (or other suitable paper or card stock) having advertising material printed on one side and postage and the advertiser's address printed on the other side, with up to 31 other cards containing messages inside the outer two cards. Thus, the recipient of the advertisement may conveniently indicate on the appropriate message unit, reply card, or post card, his level of interest in the goods or services offered and mail it back to the sender. Alternatively, the message unit may contain an indicia-bearing envelope having an advertising message and the advertiser's return address and postage printed thereon. As a result, the overall package (especially employing an edge gluing process) is less expensive than traditional envelope advertising, yet is better quality and more effective.

The prior are of which applicants are aware are as follows:

U.S. Pat. No. 2,417,982 G. B. Histed Mar. 25, 1947
U.S. Pat. No. 3,894,755 H. Cieslak et al. July 15, 1975
U.S. Pat. No. 4,079,881 A. J. Sabb Mar. 21, 1978
U.S. Pat. No. 2,045,944 G. C. Domke June 30, 1936
U.S. Pat. No. 2,243,974 H. H. Mitchell June 3, 1941
U.S. Pat. No. 2,277,265 L. F. Zahniser Mar. 24, 1942
Austrian Pat. No. 191,725 Heimhilcher September 1957

The patent to Histed discloses a greeting card in which the signature leaf is adapted to be removed to allow subsequent use of the greeting card of another party.

Similarly, Cieslak et al. disclose a multiple use greeting card in which a series of people are allowed to place their names on the card or the like so that the greeting card may be used a number of times.

The Sabb patent discloses a single use post card in which on one face a photograph may be affixed beneath a clear plastic film held to the face of the post card by an adhesive.

The Domke patent discloses a mailable blotter having a backing surface with advertising and, on the opposite side, a removable surface adapted to receive a stamp and mailing address. Removal of the latter surface reveals the blotting surface.

The patent to Mitchell discloses a folder constructed by applying an adhesive along one edge of plurality of sheets comprising the folder.

The Zahniser patent teaches a method of assembling the pages of a book wherein one edge of a plurality of the pages is subjected to thinning to thereby render the pages more strongly bound to one another by a binding material.

The Austrian patent to Heimhilcher discloses a single post card only which may have a subsequent use. The individual post card disclosed in the Heimhilcher patent does not have printed material on both sides and is, therefore, not adapted for plural use direct mail advertising. Moreover, Heimhilcher does not teach either edge binding of the individual post cards to facilitate convenient removal of the desired post card or from the package for subsequent use as a wall picture or decal.

As a result, the prior art does not allow for plural cards to be used (that is, printed) on both sides because the the gluing is not designed for mass production and subsequent similar use; nor does the prior art provide a technique to remove each unit form the glued stacks in production.

The instant invention is readily distinguished from the teachings of Histed and of Cieslak et al. in that it is directed toward a post card rather than a greeting card which must be placed in an envelope requiring first class postage and which is, therefore, more expensive to mail. Furthermore, the subject invention allows for a personalized individual message with each mailing, whereas Histed and Cieslak et al. disclose greeting cards in which the message is fixed. Accordingly, the instant invention provides a more personalized communication vehicle. In addition, the instant invention may be used in direct mail advertising, which is not taught by Histed or Cielslak et al.

The instant invention differs from the post card of Sabb in that Sabb teaches a single use post card adapted to incorporate a photo of the sender's choice while the subject invention is concerned with an integral message unit package with a plurality of removable message units which permits multiple use.

Domke discloses a mailable blotter which is sent through the mail only once, not a number of times, as is the case with the multiple use message unit package of this invention.

Mitchell discloses a method of constructing a folder, and Zahniser teaches a method of constructing a book. Both references are in art areas far removed from the multiple use message unit package of the instant invention. Moreover, Zahniser's technique would damage the post cards upon removal and is not designed to have pages removed.

The multiple use post card of Heimhilcher does not teach either edge binding of the individual cards or indexing of individual cards to facilitate convenient selection and removal of the desired card or cards as is the case with our invention. Moreover, the multiple use post card of Heimhilcher is not suitable to direct mail advertising, which is in contrast to the instant invention.

The invention disclosed and claimed in the instant application is thus readily distinguished over the foregoing art in that it provides an integral multiple use message unit package having a display surface with a plurality of individual message units preferably removably adhered to the edge of the display surface. In one embodiment of the invention, the individual message units may be adapted to be filled out with a message and an address, stamped and mailed. Upon receipt, the top message unit with the message can be removed by the recipient, revealing a fresh message unit and allowing the process to be repeated. In another embodiment of the invention, the message unit package is of direct mail advertising and the individual message units may be one or more post cards having advertising material printed on one side and postage and the advertiser's return address or service printed on the other side and intervening cards with product information. Thus, the recipient of the advertisement may conveniently indicate on the appropriate message unit his level of interest in the goods or services offered and mail a portion of the mailout back to the sender. In this second embodiment, the message unit may alternatively be an indicia-bearing envelope having an advertising message and the advertiser's return address and postage printed thereon possibly along with other cards and information. The recipient may thus enclose, for example, a check, cash or credit card information prior to mailing it back to the advertiser.

In view of the foregoing considerations, there is a strong felt, yet heretofore unfulfilled, need for the integral multiple use message unit package of the instant invention since this system has the cost benefits of post card mailing with the benefits of bulkier envelopes.

SUMMARY OF THE INVENTION

The integral multiple use message unit package of this invention provides an economical and convenient way for people to communicate via the Postal Service, stimulating its use, as well as an economical and effective means for conducting direct mail advertising. In one embodiment of the invention, the individual message units are a plurality of individual postal like cards preferably removably adhered to the edge of a display surface which may be, for example, a photograph of a historical site; a copy of a famous painting; advertising, or a humorous cartoon. At least one individual post card is provided with an area for the sender to write a message and an area for insertion of an address and placement of a postage stamp. Upon receipt, the recipient may remove the top post card with the message, revealing a fresh post card or advertising underneath. The process may then be repeated until all of the individual post cards have been used or the information contained thereon studied.

In another embodiment, the multiple use message unit package is adapted to direct mail advertising. In this embodiment, the individual message units may be post cards having printed matter advertising goods or services on one or more sides and having return postage and the advertiser's address printed on the reverse side. The plural cards can be edge glued and support in between a response envelope, or any combination of post cards, printed material envelopes, portraits, etc. The recipient of the message unit package may thus conveniently and quickly examine the individual message units and indicate his level of interest in the goods or services offered on the appropriate post card or cards and return to the sender, i.e., the advertiser. It is believed post cards have a high positive acceptance level since they traditionally connect personal correspondence and not necessarily advertising. Post cards that are not of interest to the recipient may be discarded. It is also contemplated that some or all of the individual message units may be indiciabearing envelopes having an advertising message and the advertiser's return address and postage printed thereon. The advertising message may, for example, be printed on the inside of the flap of the envelope or on the back non-addressed side. Such an indicia-bearing envelope permits the recipient of the message unit package to conveniently and safely respond to the advertisement and enclose, for example, a check or credit information prior to mailing it back to the advertiser.

It is a primary object of this invention to combine envelope(s) post card(s), or card(s) having information thereon, all dimensioned and preferably edge glued to form a compound post card.

Additionally, it is an object of the present invention to provide a multiple use post card which promotes continuous communication in commerce, among friends, family members and the like, by providing a communication link that can be remailed by simply removing the top post card; placing another stamp, or equivalent, address and message on the post card below, if necessary; and remailing, stimulating communication and the economy.

It is another object of his invention to provide a multiple use post card which encourages chain communication between individuals and/or businesses in a most cost effective manner by taking advantage of the less expensive postal rates for post cards and providing a compound post card which can be sent many times before another one need be purchased.

It is yet another object of this invention to provide a multiple use post card in which a fresh surface for a unique and personal message is provided to each sender.

It is still another object of this invention to provide a multiple use post card in which a particularly pleasing display surface may be used over and over again in multiple mailings, or it provides for each card to have a different display surface.

It is a further object of this invention to provide a multiple use message unit package in which preprinted reply sheets are furnished by politicians to ask specific questions of their constituents to thereby survey their opinions, thus offering an easier method of reply than conventional and more costly methods of public survey and effectively increasing the public's involvement in their government.

It is yet another object of this invention to provide a multiple use message unit package in which preprinted reply sheets are furnished by businesses to solicit specific responses from their customers regarding offers for warranties, insurance policies, purchase of items, etc., hence favoring a higher percentage of response and acceptance than is provided by conventional methods.

A further object of this invention is to provide coupons in place of or in addition to the series of individual message units as a promotional device for a business entity such as a casino, supermarket, retail outlet, discount promotions, etc.

Another object of this invention is to provide a multiple use message unit package in which a preprinted reply sheet as provided by physicians and dentists and the like contains helpful health messages (prevention information) and/or reminders of their patients' next appointment dates, thereby affording their patients an easy method to confirm said dates by filling out and returning the reply sheet provided.

Still another object of the instant invention is to provide a multiple use message unit package which is inexpensive, easy to manufacture, and which lends itself well to mass production techniques.

Another object provides expeditious processing, fabrication and handling by virtue of indexing provided preferably along a corner edge of the compound postcard.

The foregoing and other objects are accomplished by the practice of this invention. Broadly, viewed in one of its principal aspects, this invention consists of an integral multiple use message unit package preferably comprising:

1. A singular display surface;

2. A plurality of individual message units behind said display surface and having respective edges aligned substantially with one another and with the display surface;

3. Means for binding the message units to each other and to the edge or backside of the display surface along respective edges thereof, thereby maintaining the integrity of said message unit package during mailing, while still allowing for ease of removal and manufacturing for economy;

4. Indexing means, either tabbed or recessed, for convenient selection of one or more desired message units and removal of the desired message unit from the multiple use message unit package without tearing or separating other when not desired thus allowing mass production techniques and ease in utilization.

The nature and substance of the present invention as well as its objects and advantages will be more clearly perceived and fully understood by referring to the following description and claims taken in connection with the accompanying drawings which are described briefly below.

DESCRIPTION OF THE PREFERRED EMBODIMENTS

Figure 1:
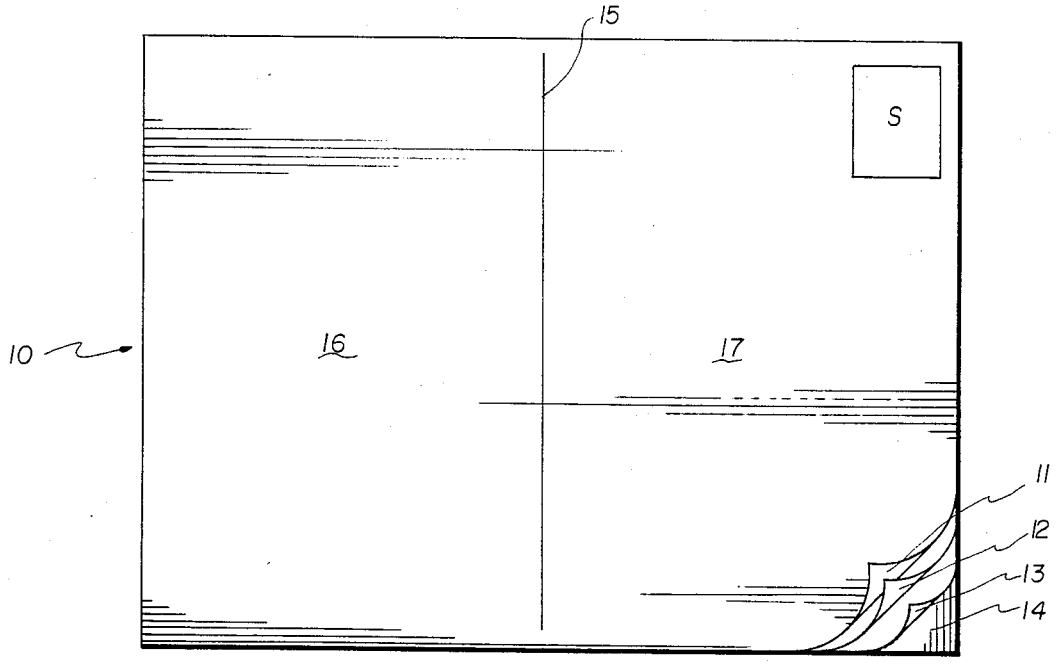
FIG. 1 is a rear view of a multiple use message unit package showing the plurality of individual message units.

Referring now to the drawings, wherein like reference numerals represent like parts throughout the several figures, reference numeral 10 refers generally to the multiple use message unit package embodied as a compound post card according to the instant invention.

FIG. 1 depicts the backside of a multiple use message unit package with the instruction sheet 9 removed, revealing a plurality of individual message units 11, 12, 13, and 14. Each message unit has an area to place a stamp S and is divided by a center line 15 into two zones 16 and 17, the right hand zone 17 being used to address the message unit package to a mailee and the left hand zone 16 being used for the message from the sender. Each successive message unit 12, 13, and 14 is substantially identical to the first message unit 11, having a left hand zone 16 for the message, a center line 15, a right hand zone 17 for the address and an area S for the stamp.

Figure 2:
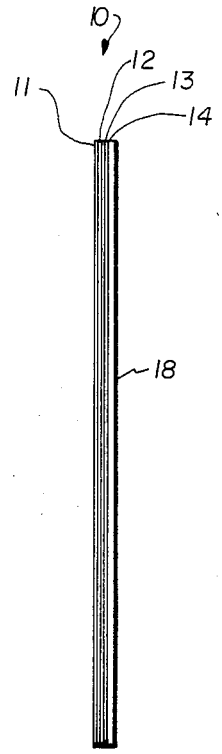
FIG. 2 is an end view of the multiple use message unit package of FIG. 1.

FIG. 2 is an end view of the multiple use message unit package of FIG. 1 showing the display surface 18 with a series of individual message units 11, 12, 13, and 14 and an instruction sheet 9 affixed to the backside of display surface 18.

Figure 3:
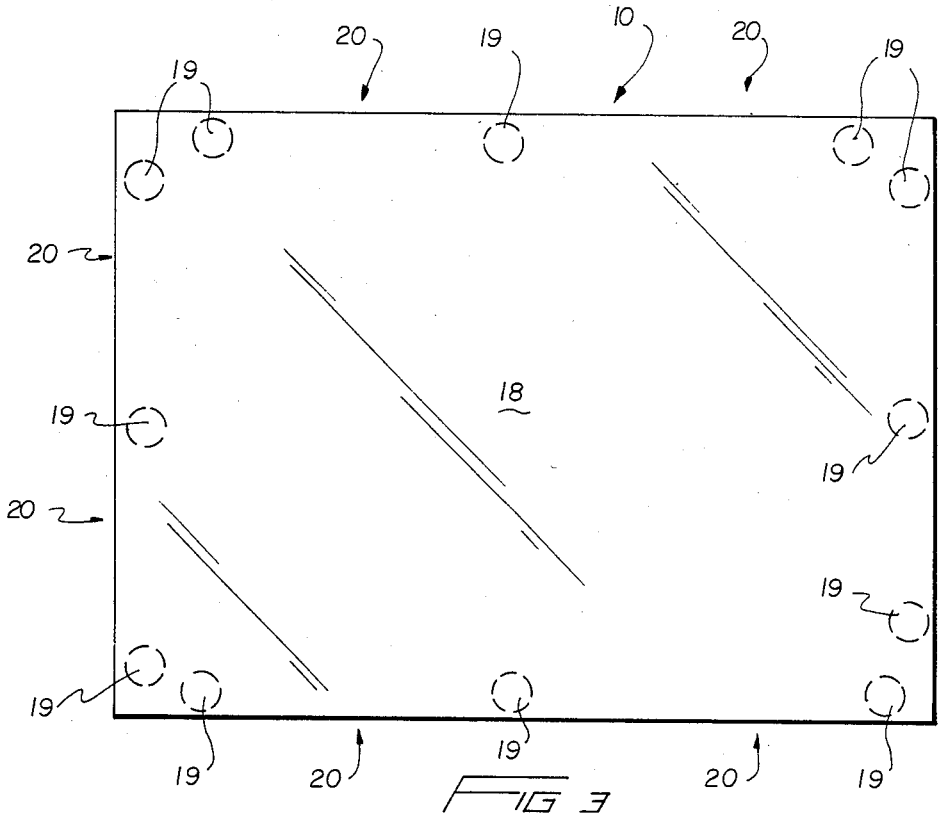
FIG. 3 is a front view of the multiple use message unit package of FIG. 1 showing the display surface and showing adhesive dots for the individual message units on the reverse side in phantom.

FIG. 3 is a front view of the multiple use message unit package of FIG. 1 with a display surface 18 which can be manufactured to carry any desired display or indicia thereon. As shown in phantom in FIG. 3, the backside of display surface 18 has a series of adhesive dots 19 disposed thereon. The adhesive dots 19 are used to affix instruction sheet 9 and message units 11, 12, 13, and 14 to each other and ultimately to the back surface of display surface 18. Each successive message unit except the top one, instruction sheet 9, has on its back surface the same configuration of adhesive dots 19 so that instruction sheet 9 and each successive message unit 11, 12, 13, and 14 is affixed to the one above and below, and ultimately to display surface 18, by the adhesive dots 19. In one embodiment, the adhesive is applied with two adhesive dots 19 in each corner and a single adhesive dot 19 medially disposed between each corner along each edge of each message unit and display surface 18. In this fashion, the corners are affixed securely and each edge is affixed medially between the corners. This configuration also provides a purchase area 20 located between any medial adhesive dot 19 and any corner adhesive dot 19. The purchase area 20 provides a position for one to slip a finger beneath the topmost message unit and remove same with a "snap action" by breaking the peripheral adhesive dots 19 in series, thereby revealing a clean message unit beneath.

Figure 4:
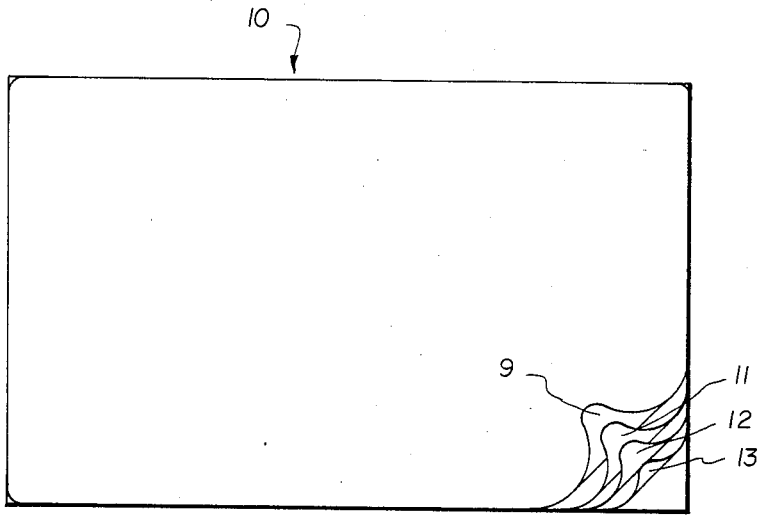
FIG. 4 is a rear view of a multiple use message unit package showing the instruction sheet 9 prior to its removal.

FIG. 4 is a rear view of the multiple use message unit package of the invention showing outermost instruction sheet 9 in position prior to removal. Instruction sheet 9 has a preprinted message containing information relevant to the uniqueness of multiple use message unit package 10, and contains instructions as to its use as well as ideas and suggestions as to its applications. Instruction sheet 9 is removed prior to sending the multiple use message unit package for the first time. It should also be noted that each individual message unit 11, 12, and 13 may also advantageously contain brief preprinted instructions on the use and reuse of the message unit package, which instructions may appear in a zone 6 along the bottom edge of each message unit 11, 12, and 13.

Figure 5:
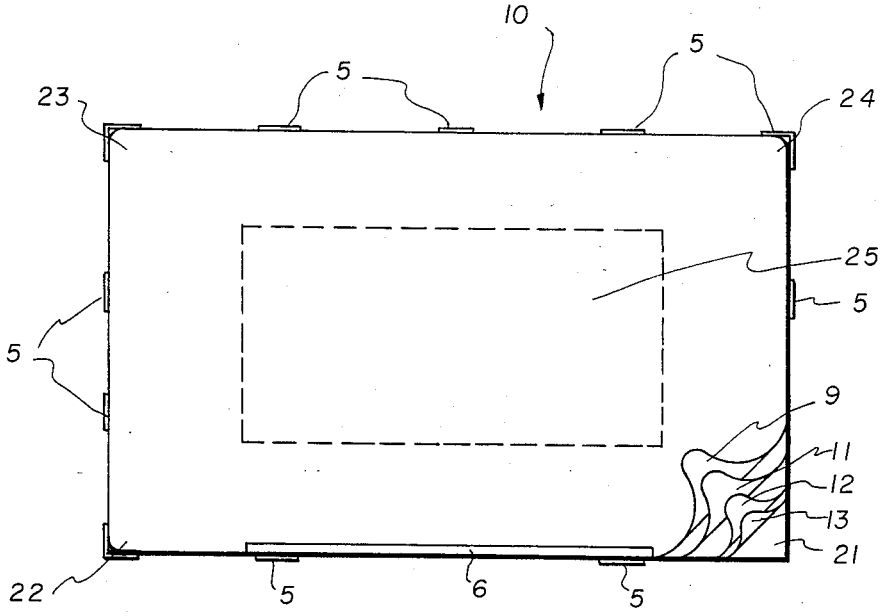
FIG. 5 is a rear view of a multiple use message unit package of the invention showing an alternate method of affixing and securing the serially disposed individual messages units and showing in phantom a coupon instead between instruction sheet 9 and message unit 11.

In the embodiment of FIG. 5, the edges of instruction sheet 9; the individual message units 11, 12, and 13; and display surface 18 have been joined together with a padding compound 5 at various locations. The padding compound 5 is similar to that used in binding legal pads and the like, and affixes instruction sheet 9 and message units 11, 12, and 13 to one another and to display surface 18. The locations of padding compound 5 provide three sealed corners 22, 23, and 24 as well as additional locations medially disposed between the corners. The medial locations of padding compound 5 may vary in number and width according to need. The remaining corner 21 is without padding compound 5 or other adhesive, and the corner of instruction sheet 9 and the corners of message units 11, 12, and 13 (but not the corner of display surface 18) are rounded or tabbed to provide a purchase area for the user to slip a finger or the like beneath the topmost sheet or message unit and remove same by peeling it upward, breaking the seals of the peripheral padding compound 5 at the various locations, and removing the sheet or message unit to reveal a fresh message unit beneath. All rounded or tabbed corners may be color coded to provide visual as well a tactile discernment. After all the message units have been removed, the final message unit is the back surface of display surface 18.

As shown in phantom in FIG. 5, a coupon sheet 25 may be inserted between topmost instruction sheet 9 and the topmost message unit 11, which captures the coupon therebetween. Alternatively, coupon 25 or a plurality of coupons 25 may also be inserted between various message units 11, 12, and 13 as desired. Furthermore, message units 11, 12, and 13 could themselves be coupons 25. While a diminutive coupon 25 has been depicted, the coupon may share the dimension of the message units 11–13.

Figure 6:
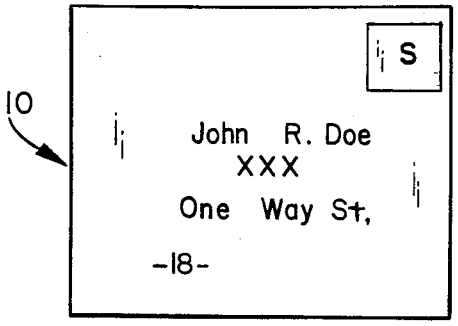
FIG. 6 is a front view of a multiple use message unit package for direct mail advertising in which the illustrated display surface is adapted to have placed thereon postage and the address of the prospective customer.

FIG. 6 is a front view of a multiple use message unit package for direct mail advertising showing display surface 18 which is adapted to have place thereon the address of the prospective customer and appropriate postage. If desired, display surface 18 may also have printed thereon indicia indicating the source and nature of the goods or services offered. Each individual message unit may have on its peripheral edge, an intermittent adhesive portion so that each successive message unit is affixed to the one above and below, and ultimately to the side edge of display surface 18. The adhesive edge portions permit individual message units to be removed with a "snap action" (FIG. 9) without danger of tearing.

Figure 7:
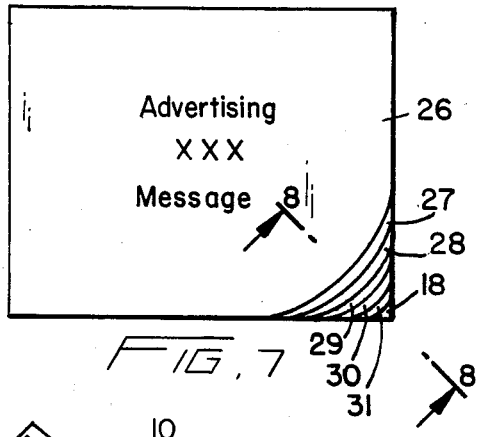
FIG. 7 is a rear view of the multiple use message unit package of FIG. 6 showing the topmost message unit with the advertising message and showing the indexing means at the lower right hand corner which permit the individual message units to be serially examined and removed in a convenient manner.

FIG. 7 is a rear view of the multiple use message unit package of FIG. 6 showing the topmost message unit 26 with the advertising message printed thereon. Beneath topmost message unit 26 is a plurality of other individual message units 27, 28, 29, 30, and 31, each of which may conveniently advertise a different product or service or expand on one product or company and one or more of which may have printed on a return reply card showing the advertiser's return address and return postage. Alternatively, some or all of message units 26, 27, 28, 29, 30, and 31 may be promotional coupons. The lower right hand corners of message units 26, 27, 28, 29, 30, and 31 are indexed by rounding on progressively greater arcs to provide terracing or a stepping stone imbrication to thereby form successively recessed indexing tabs with the arcs progressively increasing from message unit 26 to message unit 31 or vice versa. The lower right hand corner of display surface 18 is preferably not rounded. Such indexing of the individual message units permits each to be serially examined and removed in a convenient manner.

Figure 8A:
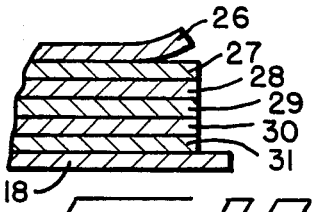
FIG. 8A is an edge view along line 8—8 of FIG. 7.
Figure 8B:
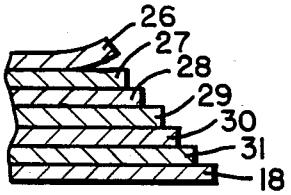
FIG. 8B is an alternate staircase embodiment 8 of 8A.

FIG. 8A and 8B are edge views along line 8—8 of FIG. 7 showing topmost message unit 26 lifted away at the lower righthand corner from the remainder of multiple use message unit package 10.

Figure 9:
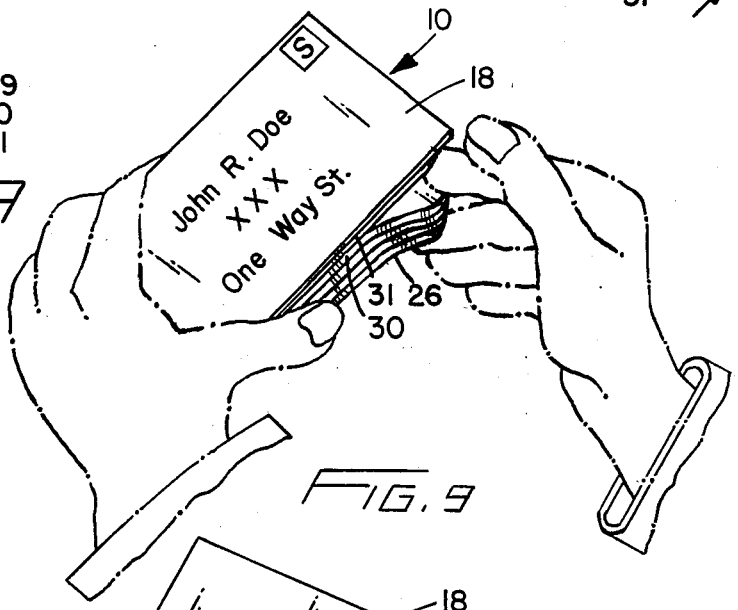
FIG. 9 illustrates a recipient of the multiple use message unit package of FIG. 6 in the process of examining the individual message units.

FIG. 9 depicts a recipient of the multiple use message unit package 10 of FIG. 6 examining the individual message units.

Figure 10:
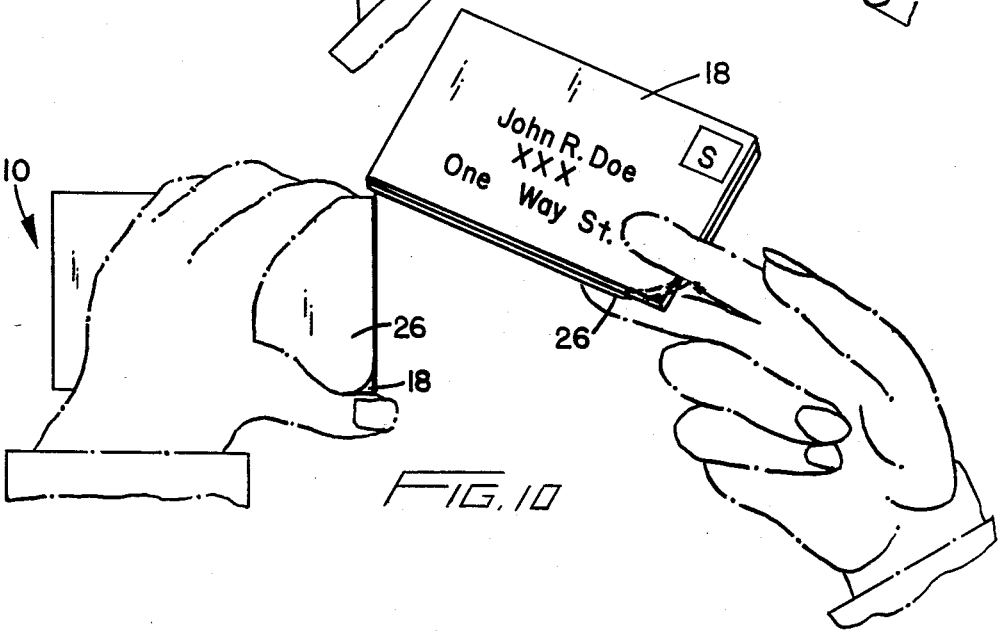
FIG. 10 illustrates the removal and discarding of the card having the display surface form the multiple use message unit package of FIG. 6.

FIG. 10 illustrates the removal and discarding of the card or sheet having the display surface 18 from the multiple use message unit package 10 of FIG. 6.

Figure 11:
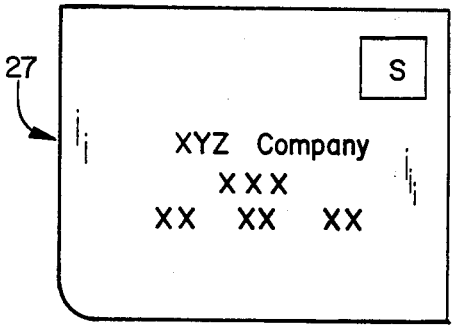
FIG. 11 is a front view of an individual message unit from the multiple use message unit package of FIG. 6 showing the originating advertiser's return address and return postage printed thereon.

FIG. 11 is a front view of an individual message unit 27 taken from the message unit package 10 of FIG. 6 showing the originating advertiser's return address and return postage printed thereon.

Figure 12:
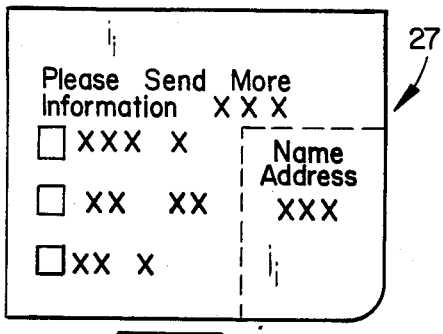
FIG. 12 is a rear view of the individual message unit of FIG. 11 having printed thereon indicia for the recipient of the multiple use message unit package to indicate his level of interest in the goods or services offered and a space for the recipient to place his name and address.

FIG. 12 is a rear view of individual message unit 27 of FIG. 11 showing the indicia printed thereon for the recipient of the multiple use message unit package to indicate his level of interest in the goods or services offered and a space for the recipient to place his name and address.

Figure 13:
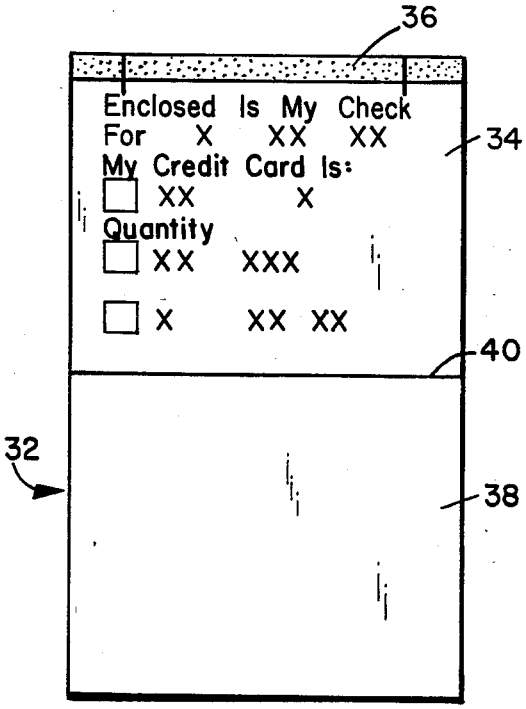
FIG. 13 is an individual message unit for direct mail advertising wherein the message unit is an indicia-bearing envelope. The message unit is open and shows the advertising message printed on the inside of the flap of the envelope and illustrates provision for insertion of, for example, a check in the envelope before sealing.

FIG. 13 is an individual additional message unit 32 for direct mail advertising wherein said message unit 32 is an indicia-bearing envelope. As illustrated, message unit 32 is unfolded open for illustrative purposes. An advertising message may be printed on the outside of flap 34 of message unit 32 (FIG. 14) or one's return address. The inner top of flap 34 has a gummed surface 36 (FIG. 13) to allow flap 34 to be sealed prior to mailing. A check, for example, may be inserted into a pocket of message unit 32 formed when fold line 40 causes the pocket to be formed when the two halves are folded at 40 and side edges are sealed. Preferably, the pocket is preformed during production by utilizing two bands of adhesive **36*a* inboard side edges. Two slits 36*a* allow an inner portion of gummed surface 36** to remain unsealed during production so the ultimate envelope user merely inserts into the pocket of the envelope and moistens the inner gummed portion, seals and mails.

Figure 14:
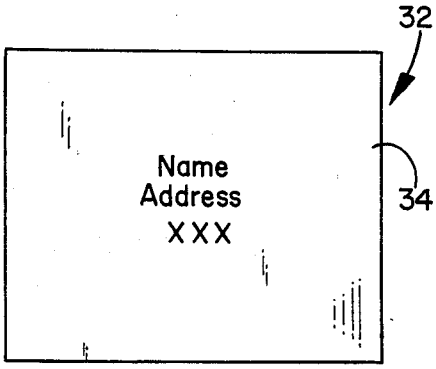
FIG. 14 is a rear view of the sealed message unit of FIG. 13 showing the originating advertiser's return address and return postage printed thereon.

FIG. 14 is a rear view of the sealed message unit 32 of FIG. 13 showing on flap 34 thereof the name and address of the recipient of the multiple use message unit package containing message unit 32.

Figure 15:
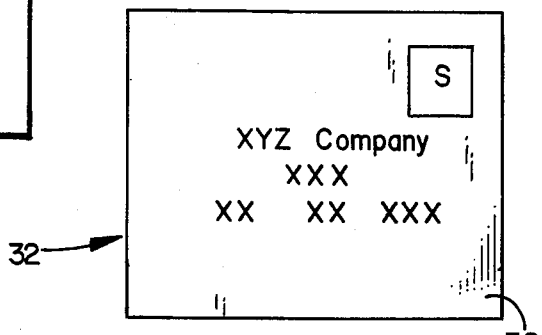
FIG. 15 is a front view of FIG. 14.
Figure 16:
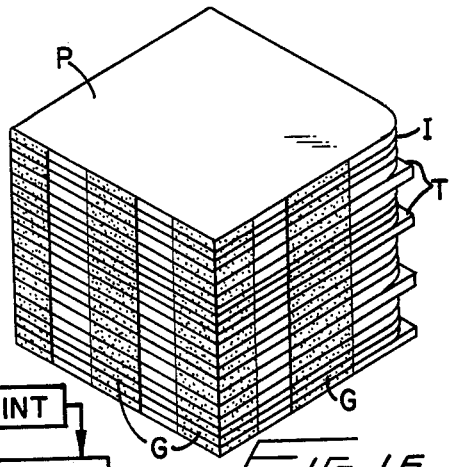
FIG. 16 is a perspective view of a stack of compound postcards prior to separation.
Figure 17:
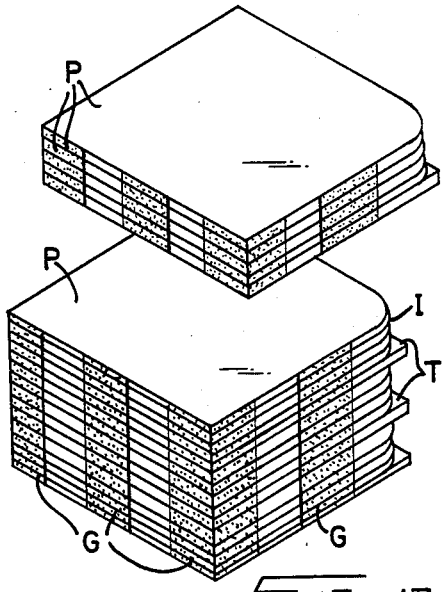
FIG. 17 shows one compound post card removed from the stack.

FIG. 15 is a front view of the sealed message unit 32 of FIG. 13 showing the originating advertiser's return address and return postage printed on the pocket 38 thereof.

In one form the integral multiple use message unit package of the instant invention may be used as a communication vehicle between two chess players with, for example, famous chess positions pictured on display surface 18. The individual message units would be used to convey the moves of a chess game through the mail. In this manner, a chess player could remove the message unit containing his opponent's move, write his move on the message unit beneath, and remail the message unit package.

Alternatively, display surface 18 may contain a particularly attractive work of fine art, a comic anecdote, or any other indicia, which may appeal to a group of people such as family members, a particular club, or individuals with common interests such as those choosing to exchange recipes or communicate with children at summer camp, so that a single card with the associated display surface can be circulated to individuals who would appreciate it most without having to purchase a new card for each successive mailing. If desired, the display surface can be left blank so that the user may create his or her own display. The package may also be embodied as seasonal or occasional "greeting" cards and announcements such as for parties and invitations where a return response is expected or desired.

In another embodiment of the invention, the multiple use message unit package is adapted to direct mail advertising. In this embodiment, the individual message units may be dimensioned as post cards having printed matter advertising goods and services on one side, and having return postage and the advertiser's address printed on the other side. The dimension of the package may also be larger or smaller than post cards. The recipient of the message unit package may thus conveniently and quickly examine the individual message units and indicate his level of interest in the one or more goods or services offered on the appropriate post card or cards and return to the sender. Post cards that are not of interest to the recipient may be discarded. It is also contemplated that some or all of the individual message units may be indicia-bearing envelopes having a pocket, and advertising message and the advertiser's return address and postage printed thereon. The recipient of such a message unit may thus conveniently and safely respond to the advertisement and enclose, for example, a check or indicate information on one's credit card prior to mailing it back to the advertiser.

Thus, it can be seen that the mailer according to the present invention really defines a compound mailer which is preferably dimensioned the size of a post card, but of course can be scaled to any dimension that meets the guidelines of the post office.

Thus, a compound mailer has been provided which is formed from a plurality of panels of sheet material, with printing on the sheet material which can be varied for the intended purpose. Each of the sheets may take the form of a pictorial display, an envelope which is fabricated such that the flap which seals the associated envelope pocket does not provide a nonuniform thickness along the length of the envelope so that when a plurality of compound mailers are stacked, the thickness of the entire stack is uniform. Coupons, reply cards, and the like can all be included in the compound mailer for the associated purposes and benefits set forth herein above.

FIGS. 16–20 reflect a particular embodiment which facilitates the operative production of a plurality of compound mailers so that they are collated and stacked to form mailer bundles. As shown in FIGS. 16–19, a plurality of panels are provided stacked and one corner of the stack in vertical alignment is provided with a plurality of indicators defined as imbrications I, which effectively form terraces, relative to adjacent panel facilitating separation. One panel P has not been cut thereby forming a tab T which denotes the periodicity of adjacent mailing packages. That is to say, the information on each panel P repeats itself regularly and is in the same place within each mailing package provided in a bundle stack formed from several packages so that the same information is found on each panel having the tab T. For example, the panel below the panel having a tab T is identical to a similarly placed panel next to another panel having a tab T.

The edges of a bundle of such panels disposed in a stack as shown are treated intermittently with glue disposed in a vertically linear path around the periphery of the bundle, so that each panel can be readily disassociated from an adjacent panel by flexing or lifting at the tab area the card and allowing the adjacent card to separate and disassociate one from the other by severing the glue between the adjacent edges. As shown in the drawings, the area immediately surrounding the tab T and indicators I are devoid of glue so that an area is provided to facilitate the separation of adjacent panels P as should be evident. The remaining three corners of each bundle have glue treatment preferably on the corners, and another vertical strip of glue is disposed at various places between the corners. Clearly, an elongate rectangular mailer which would be a somewhat larger postcard would have more vertical extending strips of glue than in the examples of 16–19.

Figure 20:
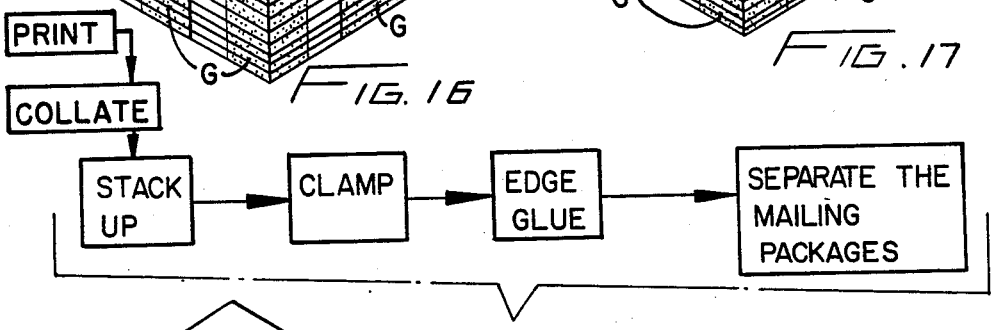
FIG. 20 reflects a method of fabrication for FIGS. 16–19.
Figure 18:
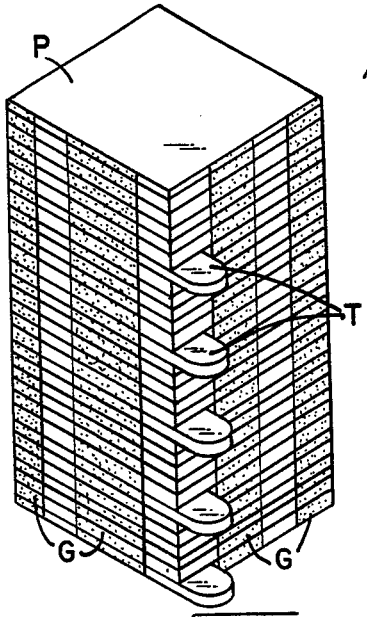
FIG. 18 is an alternative embodiment of FIG. 16.
Figure 19:
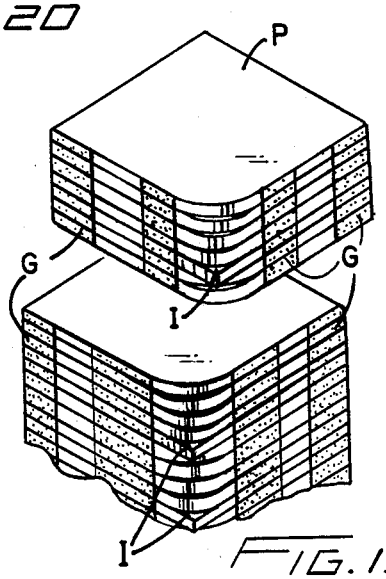
FIG. 19 is an embodiment similar to FIG. 18 separated.

FIG. 20 shows the preferred method for forming a bundle of mailer packages and includes printing on a plurality of substantially equidimensioned panels different information to define one pack of information, collating the printed panels so that the panels containing identical information are equally and uniformly dispensed, placing the panels on a vibrating support to align two panel side edges adjacent the indices into planar surfaces, and trimming the remaining two side edges (remote from the indices, by cutting) to form two more planar surfaces thus "squaring" the plural panels, stacking the collated packages to align respective edges of each package, securing by clamping the thus formed stack from misalignment, and intermittently gluing the peripheral edges of the stack to form a bundle of mailers which can be later disassociated. Note that with the envelopes defined above, the trimming step beneficially occurs at the gummed portion 36 and on one glued side edge, thereby not compromising the utility of the envelope, which was structured for this step and to provide uniform bundle thickness, an important feature. Since the tabs T extend beyond one corner of the indicator area, this can be used as a guideline when disassociating individual compound packets. It is contemplated that when a subscriber orders a large quantity of the mailers, the method delineated immediately herein and above will allow a plurality of mailers to be bundled and sent to the ultimate user, who can either dispense them individually by severing along the indicator tab T, or make them available for public shows, etc. or the manufacturer separates the bundles into the individual units as should be evident. Thus, an economically feasible product has been developed which benefits from the economy of scale associated with high speed printing, collating, and separating and concomitantly benefits from the reduced postal rates that are bestowed upon articles of mailing generally defined as post cards.

The only limitation on the number of panels that can be adjoined to serve as a mailer are limitations proscribed by the postal service, and the individual constituency of each panel is dictated by the specific needs of the ultimate user. Thus, respective panels may take the form of reply envelopes, reply post cards, coupons, promotional offers, printed information about products and/or services, greetings, invitations, condolences, etc.

While specific embodiments of the present invention have been shown and described in detail to illustrate the utilization thereof, it is to be understood that such showing and description have been offered only by way of example and not by way of limitation. Protection by Letters Patent of this invention in all its aspects and equivalents is set forth in this appended claims and is sought to the broadest extent that the prior art allows.

We claim as our invention:

1. An integral multiple use message unit package comprising a singular display surface; a plurality of individual message units behind said display surface and having respective edges aligned substantially with one another and with the display surface; means for intermittently binding the message units to each other along a periphery thereof, thereby maintaining the integrity of said message unit package during mailing; and indexing means on said package for convenient selection of one or more desired message units and removal of the desired message unit from the multiple use message unit package without compromising the integrity of the remaining package.

2. An integral multiple use message unit package for direct mail advertisements and the like comprising a display surface adapted to have a mailee's name and address placed thereon; a plurality of individual message units for return mail connected thereto, said message units having respective edges aligned substantially with one another and with said display surface; means for binding the message units to each other along a periphery thereof, thereby maintaining the integrity of said message unit package during mailing; and wherein said message unit package has a corner provided with successively imbricated indexing tabs on the individual message units, thereby facilitating a convenient selection of one or more desired message units and removal thereof from the multiple use message unit package without comprising the integrity of the remaining package.

3. An integral multiple use message unit package for direct mail advertisements and the like comprising a display surface adapted to have a mailee's name and address placed thereon; a plurality of individual message units for return mail attached thereto, said message units having respective edges aligned substantially with one another and with said display surface; means for binding the message units to each other and to the backside of the display surface along a periphery thereof, thereby maintaining the integrity of the message unit package during mailing; and wherein said individual message units comprise at least one post card having printed material on both sides thereof and at least one indicia-bearing envelope.

4. The integral multiple use message unit package of claim 3 wherein said indicia-bearing envelope has an advertising message and the advertiser's return address and postage printing thereon.

5. An integral multiple use message unit package for direct mail advertisements and the like comprising a display surface adapted to have a mailee's name and address placed thereon; a plurality of individual message units for return mail, said message units having respective edges aligned substantially with one another and with said display surface; means for binding the message units to each other and the display surface along respective edges thereof, thereby maintaining the integrity of the message unit package during mailing; and wherein said message unit package has a corner provided with successively recessed indexing tabs on the individual message units, thereby facilitating a convenient selection of one or more desired message units and removal thereof from the multiple use message unit package without tearing and wherein further at least one of said message units comprises a return-mail, postage-prepaid post card having printed material on both sides thereof and at least another one of said message units comprises a return-mail, postage-prepaid envelope.

6. An integral multiple use message unit package for direct mail advertisements and the like comprising a display surface adapted to have a mailee's name and address placed on an exposed surface; a plurality of individual post cards for prepaid return mail, said post cards having printed material on both sides thereof and wherein said post cards have respective edges aligned substantially with one another and with said display surface; means for binding the post cards to each other and to the display surface along all of the respective side edges thereof, thereby maintaining the integrity of the message unit package during mailing; and wherein said message unit package has a corner provided with successively recessed indexing tabs on the individual post cards, thereby facilitating a convenient selection of one or more desired post cards and removal thereof from the multiple use message unit package without tearing said post card.

7. The integral multiple use message unit package of claim 6, further including a return-mail, postage-prepaid envelope as an individual message unit.

8. The integral multiple use message unit package of claim 6, further including a redeemable coupon as an individual messages unit.

9. The integral multiple use message unit package of claim 1 wherein said individual message units are adapted to have placed thereon individual messages, a mailee's address and appropriate postage and wherein said display surface is an attractive picture.

10. The integral multiple use message unit package of claim 1 wherein said means for binding the message units to each other and to the backside of the display surface along respective edges thereof is a plurality of adhesive dots which permit said message units to be separated from the message unit package with a "snap action."

11. The integral multiple use message unit of claims 1, 2, 3, 5, and or 6 wherein said binding means comprises adhesive placed intermittently about the edges of the aligned plural message units, an area proximate to and at said indexing means devoid of adhesive to allow manipulation of said indexing means.

12. The integral multiple use message unit of claim 11 wherein said indexing means includes color codification to provide visual discernment.

13. The integral multiple use message unit of claim 4, 5, or 7 wherein said envelope is formed as two coextensive panels devoid of a thickening flap.

14. A plurality of integral multiple use message unit packages each formed form plural panels of stock material embodied as post cards, envelopes, coupons, indicia-bearing surfaces or the like and vertically stacked, aligned and dimensioned such that all panels have edges in registry, indicia means on one corner of each said panel vertically aligned, and each said package is identically collated with respect to said panels and indicia means such that said indicia means and said panels form a repetitive pattern when said plurality of packages are vertically stacked and aligned, vertically disposed strips of adhesive intermittently placed down edges of said plurality of stacked packages remote from said indicia means whereby said plurality of stacked packages are separated into individual packages each containing plural panels by repetitive severing adjacent a one recurring indicator of said indicia means.

15. The integral multiple use message unit of claim 14 wherein said indicia means are imbrications at one corner of each said panel.

16. The integral multiple use message unit of claim 15 wherein said indicia means are color coded.

17. The integral multiple use message unit of claim 16 wherein said envelope is formed form two panels equally dimensioned to preclude a thickening flap.

18. A method of forming a multiple use mailer comprising the steps of:

printing on a plurality of substantially equidimensioned panels different information to define one package of information, collating the printed panels so that panels containing identical printed information are equally dispensed, stacking collated packages to align respective edges of each package, constraining the thus formed stack from misalignment, and intermittently gluing the peripheral edges of the stack to form a bundle of mailers which can be later disassociated.

19. The method of claim 18 including providing a tactile indicator on each said panel unique to the printing information on the panel prior to collating, and collating so that the indicator for each mailer package cyclically repeats during stacking.

20. The method of claim 19 including providing a visual indicator with the tactile indicator.

21. The method of claim 19 including leaving the area of the indicator unglued.

22. A method of forming a multiple use mailer comprising the steps of:

providing indexing means on a plurality of panels forming the mailer, stacking the panels so that the indexing means provides a repetitive pattern, clamping the panels in a fixed position such that respective side edges of each panel are aligned, and gluing portions of the side edges to form a cohesive bundle.

23. The method of claim 22 including separating the panels into sets defined by one cycle of the repetitive pattern, the thus formed set defining a single multiple use mailer.

24. The method of claim 22 including embodying one panel as an envelope of uniform thickness throughout by forming the envelope as a blank, folding the blank along a centerline thereof, gluing together registered inboard side edges of the envelope that extend from the line formed by folding, slitting one top edge of the blank towards the foldline inboard the glued side edges and applying glue to one of the two top edges, inboard thereof, and facing the interior of the pocket thus formed to allow sealing of the envelope, whereby trimming the envelope along a side edge and top edge remote from the indexing means does not alter the utility of the envelope.

25. A renewable post card intended for multiple mailings, comprising a single display card, a plurality of tablet sheets, each of which may be removed sequentially, wherein the display card and tablet sheets have respective marginal side edges, means including a plurality of substantially individual adhesive elements disposed substantially along the respective side edges of the display card and tablet sheets for removably joining the tablet sheets to each other and to the display card, whereby the integrity of the renewable post card for mailing purposes is assured, and whereby the individual tablet sheets may be conveniently removed suquentially without tearing thereof.

26. The improvement of claim 25, wherein the adhesive elements comprise a plurality of spaced adhesive dots adjacent to the respective side edges of the display card and tablet sheets and interspersed therebetween.

27. The improvement of claim 25, wherein the adhesive elements comprise a gluing compound disposed directly directly along the respective side edges of the display card and tablet sheets.

28. The improvement of claim 27, wherein the renewable post card is rectangular and has four corners, including a lower right-hand corner, and wherein the gluing compound is disposed at three corners and intermediately thereof, but is deleted from the lower right-hand corner, thereby providing a purchase area for facilitating a convenient sequential removal of the tablet sheets.

* * * * *